US009867422B2

(12) United States Patent
Cai

(10) Patent No.: US 9,867,422 B2
(45) Date of Patent: Jan. 16, 2018

(54) CUSTOMIZABLE FOOTWEAR AND METHOD

(71) Applicant: WCF Shoes, Inc., Walnut, CA (US)

(72) Inventor: Jian Cai, Walnut, CA (US)

( * ) Notice: Subject to any disclaimer, the term of this patent is extended or adjusted under 35 U.S.C. 154(b) by 0 days.

(21) Appl. No.: 14/640,279

(22) Filed: Mar. 6, 2015

(65) Prior Publication Data

US 2016/0174651 A1 Jun. 23, 2016

Related U.S. Application Data

(60) Provisional application No. 62/095,050, filed on Dec. 21, 2014.

(51) Int. Cl.

| | |
|---|---|
| ***A43B 3/24*** | (2006.01) |
| ***A43B 1/00*** | (2006.01) |
| ***A43B 3/00*** | (2006.01) |
| ***A43B 3/10*** | (2006.01) |
| ***A43B 23/24*** | (2006.01) |

(52) U.S. Cl.

CPC ..... *A43B 3/242* (2013.01); *A43B 1/0027* (2013.01); *A43B 3/0078* (2013.01); *A43B 3/105* (2013.01); *A43B 23/24* (2013.01)

(58) Field of Classification Search

CPC ..... A43B 3/242; A43B 3/0036; A43B 3/0078; A43B 3/12; A43B 3/122; A43B 3/126; A43B 23/24; A43B 3/0068; A43B 3/128; A43B 3/24; A43B 3/244; A43C 11/00; A43C 11/04; A43C 11/14; A43C 11/24

USPC ..... 36/100, 11.5, 101, 7.5, 15; D2/916

See application file for complete search history.

(56) References Cited

U.S. PATENT DOCUMENTS

| | | | | |
|---|---|---|---|---|
| 2,551,723 A * | 5/1951 | Camero | A43B 3/126 36/11.5 |
| 3,978,596 A * | 9/1976 | Brown | A43B 3/122 12/142 S |
| 7,272,899 B1 * | 9/2007 | Marak | A43B 3/122 36/101 |
| 7,823,299 B1 * | 11/2010 | Brigham | A43B 3/105 36/100 |

(Continued)

OTHER PUBLICATIONS

Bikini Shoes, Fresch Style, Aug. 6, 2014, http://freschstyle.com/bikini-shoes/, accessed Nov. 23, 2015.*

*Primary Examiner* — Jameson Collier
*Assistant Examiner* — Heather Mangine
(74) *Attorney, Agent, or Firm* — Tommy SF Wang; Wang IP Law Group, P.C.

(57) ABSTRACT

A footwear having traditional functionality utilizes uppers that substantially resemble and function as a bikini bra section and a bikini groin section, with each bikini section attachable to the footwear with various decorative fasteners, such as, bikini tie strings, toggles, and ornamental members. The front and rear uppers are substantially triangular and elastic, like a bikini. A sole has a front sole section and a rear sole section. The front upper has at least one front fastening member and at least one front decorative member. The rear upper has at least one rear fastening member and at least one rear decorative member. The rear upper is optional. The front and rear fastening members attach to their respective side of the soles and to each other. A front and rear reinforcing member at each respective upper maintains the uppers to the front and heel of the feet.

8 Claims, 5 Drawing Sheets

(56) References Cited

U.S. PATENT DOCUMENTS

| | | | | |
|---|---|---|---|---|
| 8,250,780 | B1 * | 8/2012 | Diaz | A43B 3/122<br>36/101 |
| 8,516,725 | B1 * | 8/2013 | George | A43C 11/16<br>24/714.8 |
| 8,881,426 | B1 * | 11/2014 | Elze | A43B 23/24<br>36/11.5 |
| 2009/0293312 | A1 * | 12/2009 | Scozzafava | A43B 3/122<br>36/101 |
| 2012/0272427 | A1 * | 11/2012 | Scozzafava | A41D 7/00<br>2/67 |
| 2013/0340286 | A1 * | 12/2013 | Schindler | A43B 3/244<br>36/101 |
| 2014/0259739 | A1 * | 9/2014 | Yen | A43B 3/122<br>36/11.5 |

* cited by examiner

CUSTOMIZABLE FOOTWEAR AND METHOD

CROSS-REFERENCE TO RELATED APPLICATIONS

This Non-Provisional Patent Application claims priority from the Provisional Patent Application No. 62/095,050.

FIELD OF THE INVENTION

The present invention relates generally to customizable and personalized footwear having swimsuit uppers. More so, a customizable footwear having traditional functionality utilizes uppers that substantially resemble and function as a lower bikini groin section and an upper bikini bra section, with each bikini section attachable to the footwear with various decorative fasteners, such as, bikini tie strings, toggles, and ornamental members that enable customization and personalization of the footwear, while also forming a bikini-style appearance to the footwear.

BACKGROUND OF THE INVENTION

Typically, footwear is an everyday garment worn on the feet for fashion, protection against the environment, and adornment. There are myriad shapes, sizes, and types of footwear, depending on the type and requirements of a user. Typical types of footwear include, sandals, flip flops, tennis shoes, dress shoes, boots, high heels, ballet shoes, penny loafers, and snow shoes.

It is known that footwear is intended to protect and comfort the human foot while doing various activities. Footwear is also used as an item of decoration. Generally, fashion has often dictated many design elements of the footwear, such as whether the footwear has very high heels or flat ones. Contemporary footwear varies widely in style, complexity and cost. Basic sandals may consist of only a thin sole and simple strap. High fashion footwear may be made of very expensive materials in complex construction and sell for thousands of dollars a pair. Other footwear are for very specific purposes, such as boots designed specifically for mountaineering or skiing.

Often, footwear consists of a base for supporting the foot and uppers for securing the foot to the base. Many styles of footwear, constructed of various components, have long existed. The uppers play a large role as to the appearance and function of the shoe. The uppers may be of a variety of colors and materials, such as fabric, leather or a synthetic material. Certain shoes have been manufactured with removable uppers for varying the appearance of the shoe.

In many instances, a bikini is used during swimming, sunbathing, bathing, or lounging. The bikini typically consists of a woman's two-piece swimsuit that comprises panties-style bottoms that cover at least a female's crotch and a bra-style top that covers at least her breasts, but which leaves her midriff exposed, and usually the navel and waist. The bikini can have a wide variety of shapes, accessories, colors, and textures. Aesthetics play a large part in the adornment of bikinis.

Other proposals have involved for interchanging parts of the footwear. The problem with these devices is that they do not allow for customizable uppers, lowers, and decorative ornaments to be connected to the footwear. The present invention provides this capacity through customizable and personalized footwear having swimsuit uppers.

Thus, an unaddressed need exists in the industry to address the aforementioned deficiencies and inadequacies. Even though the above cited methods for decorative footwear having some interchangeable parts meets some of the needs of the market, a customizable footwear having traditional functionality that utilizes uppers that substantially resemble and function as a lower bikini groin section and an upper bikini bra section, with each bikini section attachable to the footwear with various decorative fasteners that enable customization and personalization of the footwear, while also forming a bikini-style appearance to the footwear.

SUMMARY OF THE INVENTION

The present invention is directed to a customizable footwear and method with interchangeable uppers and decorative ornaments. In some embodiments, the footwear provides traditional functionality with a front upper and a rear upper that substantially resemble and function as a bikini bra section and a bikini groin section, respectively. Each upper is connected to a sole on the footwear, and also to each other through various decorative and functional fasteners, including bikini tie strings, toggles, rings, and at least one front ornamental member and at least one rear ornamental member.

The ornamental members serve the dual function of ornamental accessory and fastening mechanism; thereby giving the appearance of a bikini style swimsuit to the footwear while it is being worn. It is significant to note that the ornamental members are not required for the footwear, but are optional. The rear upper is also optional. Furthermore, the interchangeability of uppers and ornamental members allows the footwear to be customized and personalized to a user's tastes and needs.

In some embodiments, the footwear may include any type of covering for the feet, including, without limitation, sandals, flip-flops, house slippers, tennis shoes, pumps, stilettoes, boots, heels, and dress shoes. The swimsuit, which the uppers resemble, may include, without limitation, a two-piece bikini, a monokini, a microkini, a tankini, a trikini, a pubikini, a bandeaukini, a trikini, a skirtini, a sling bikini, a man's brief swimsuit, a one piece swimsuit, a knicker, a wetsuit, a board short, and a T-top.

One aspect of the customizable footwear with uppers that substantially resemble a swimsuit, comprises:

- a sole, the sole defined by a front sole section and a rear sole section;
- a front upper, the front upper defined by a substantially triangular shape, the front upper joined with the front sole section;
- at least one front fastening member disposed to extend from the front upper, the at least one front fastening member configured to join with the front sole section;
- at least one front ornamental member configured to provide an ornamental affect and/or form a point of attachment for the front upper;
- a rear upper, the rear upper defined by a substantially triangular shape, the rear upper joined with the rear sole section;
- at least one rear fastening member disposed to extend from the rear upper, the at least one rear fastening member configured to join with the rear sole section, the at least one front fastening member, and the at least one front ornamental member; and
- at least one rear ornamental member configured to provide an ornamental affect and/or form a point of attachment for the rear upper.

One objective of the present invention is to provide a customizable and personalized footwear that has interchangeable uppers and ornamental members.

Another objective is to provide front and rear uppers that substantially resemble a bikini Yet another objective is to provide an optional rear upper for the footwear.

Another objective is to provide interlinking hooks or straps for the front sole section.

Yet another objective is to provide trinkets that are easily detachable from the footwear through various fasteners, such as spring clasps, lag screws, latches, clips, and hook and loop fasteners.

Yet another objective is to provide decorative front and rear ornamental members.

Yet another objective is to provide a customizable insole and outsole, wherein the insole and the outsole are interchangeable and can be changed by pattern, design, shape, size, and style.

Yet another objective is to provide a connecting chain that includes interlinking pearls and custom jewelry.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
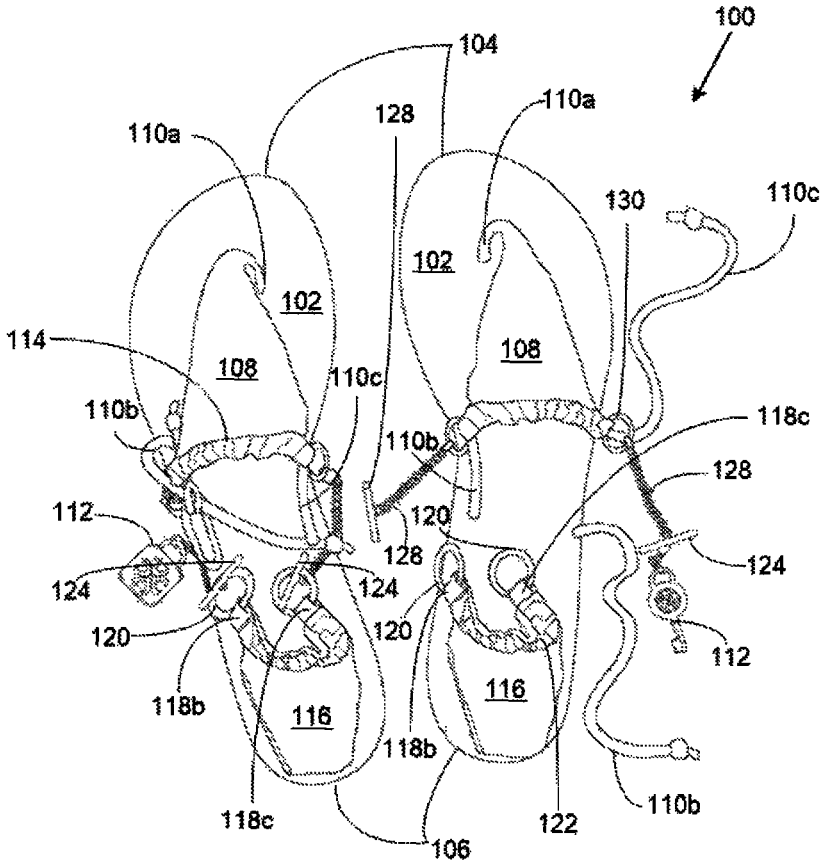
FIG. 1 illustrates a top view of a pair of an exemplary footwear with swimsuit uppers, showing a left footwear with the fastening members fully fastened together, and a right footwear showing the fastening members detached from each other, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "first," "second," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

In one embodiment of the present invention, presented in FIGS. 1-5, a customizable and personalized footwear 100, hereinafter "footwear" provides traditional functionality of footwear 100 with a front upper 108 and a rear upper 116 that substantially resemble and function as a bikini bra section and a bikini groin section, respectively. Each upper 108, 116 is connected to a sole 102 on the footwear 100, and also to each other through various decorative and functional fasteners, including bikini tie strings, toggles, rings, and at least one front ornamental member 112 and at least one rear ornamental member 120. In one embodiment, the rear upper 116 is optional, so as to provide greater customization to the footwear 100.

The footwear 100 provides numerous advantages over traditional shoes in that it forms a customizable and personalized footwear that has interchangeable uppers 108, 116 and ornamental members 112, 120. Another advantage of the footwear 100 is that the front and rear uppers 108, 116 that substantially resemble a bikini. Yet another advantage is that the rear upper 116 is optional so as to increase the customization of the footwear 100.

Additionally, the footwear 100 is adapted to be interchangeable at the insole and the outsole, in much the same way the ornamental members 112, 120 are interchangeable. In this manner, a different pattern and design can be used for the same footwear 100. In some embodiments, the insole and the outsole are interchangeable and can be changed by shape, size, and style. For example, the outsole can be customized to have a platform 132, a heel 134, or simply to remain flat 136. The interchangeability can be integrated with the interchangeability of the ornamental members 112, 120 to create even more combinations.

In some embodiments, the footwear 100 may include interlinking hooks or straps for a front sole section 104. In other embodiments, the footwear 100 provides a trinket 138 that is easily detachable from the uppers 108, 116 through various fasteners, such as spring clasps, lag screws, latches, clips, and hook and loop fasteners. Another advantage provided by the footwear 100 is a decorative front ornamental members. Another objective is to provide a connecting chain between uppers 108, 116 that includes interlinking pearls and custom jewelry.

In some embodiments, the footwear 100 may include a sole 102 having a front sole section 104 and a rear sole section 106. The front sole section 104 may be disposed in the general direction where the toes are placed. The rear sole section 106 may be disposed in the general direction where the heel is placed. The sole 102 forms a supportive foundation for the footwear. The sole 102 also provides a base of attachment for the front and rear uppers 108, 116. Suitable materials for the sole 102 may include, without limitation, leather, rubber, foam, polyurethane, canvas, cork, polymers, fibers, and filler.

A front upper 108 and a rear upper 116 join with the sole 102 to help retain the foot on the sole 102, and also to create the appearance of swimwear. It is significant to note, however, that the rear upper 116 is optional. The front upper 108 is proximal to the front sole section 104. The rear upper 116 is proximal to the rear sole section 106. The substantially swimsuit shaped uppers 108, 116 create a bikini type appearance for the footwear 100, revealing a substantial section of the foot and toes, while still covering a small area on the feet. In one embodiment, the uppers 108, 116 have a generally triangular shape, with the rear upper 116 being wider, as in the buttocks section of the bikini. The front upper 108 can be triangular with a first front edge, a second front edge, a third front edge, a first front corner, a second front corner and a third front corner. The rear upper 116 can also be triangular with a first rear edge, a second rear edge, a third rear edge, a first rear corner, a second rear corner and a third rear corner. The third rear corner is directly connected to the rear sole section 106. The uppers 108, 116 can take any variety of shapes, colors, textures, patterns, and materials that are conducive to creating a bikini-type appearance.

Those skilled in the art will recognize that a bikini is generally a two-piece swimsuit that comprises panty-style bottoms that cover at least a female's crotch, and a bra-style top that covers at least her breasts, but which leaves her midriff exposed, and usually the navel and waist. Similarly to the bikini style bottoms of the bikini swimwear, the footwear 100 with swimsuit shaped uppers 108, 116 utilizes a front upper 108 that has a substantially triangular shape; as would normally cover a bra section with a bikini. The rear upper 116 on the footwear 100 has a substantially triangular shape; as would normally cover a groin section with a bikini Furthermore, the material composition of the uppers 108, 116 utilizes a wide variety of materials, some of which may be found in bikinis. The material may include, without limitation, leather, polyester, canvas, sequins, cotton, synthetic fibers, and woven and nonwoven materials. In any case, a substantial amount of the foot is left uncovered, and the section of the foot that is covered by the uppers 108, 116 resembles a body wearing swimwear, and specifically bikini style swimwear. It is significant to note that, though the footwear 100 may resemble a bikini commonly worn by women, a man may wear the footwear 100. In one embodiment, the footwear 100 is designed specifically for a man.

Figure 2:
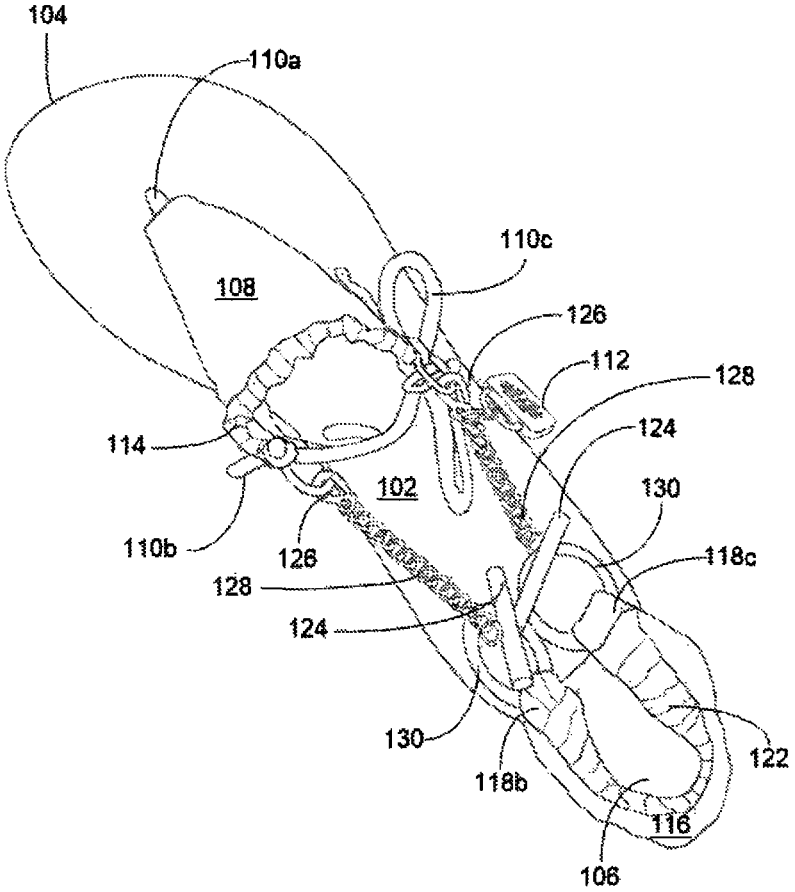
FIG. 2 illustrates a perspective top view of the footwear showing front ornamental members attached to rear fastening members, in accordance with an embodiment of the present invention.

Turning now to FIG. 2, the third front edge of the front upper 108 may be defined by a front reinforced edge 114 that helps maintain the front upper 108 on the front area of the foot, proximally to the toes. The front reinforced edge 114 may include an elastic band that traverses the front of the foot. In some embodiments, the front upper 108 may also be defined by at least one front fastening member 110*a* located at the third front corner and joins the front upper 108 to the front sole 106, 110*b* located at the second front corner, 110*c* located at the first front corner.

The at least one front fastening member 110*a*, 110*b*, 110*c* may include three elongated fastening members 110*a*, 110*b*, 110*c* that are arranged at the apexes of the generally triangular shape on the front upper 108. The most forward of the fastening members 110*a* may attach to the most forward section of the sole 102. In this manner, a toe divider is formed. The other two front fastening members 110*b*, 110*c* are more rearwardly disposed. The two rearwardly disposed front fastening members 110*b*, 110*c* may permanently fasten to the sides of the sole 102, or to fasten to the rear upper 116, so as to wrap around the foot while on the sole 102. In one alternative embodiment, the at least one front fastening member 110*a*, 110*b*, 110*c* arrives from the manufacturer prelaced in a tied up configuration. In one example, drawstrings are tied together around the front upper 108 in a decorative, rather than functional manner.

Figure 3:
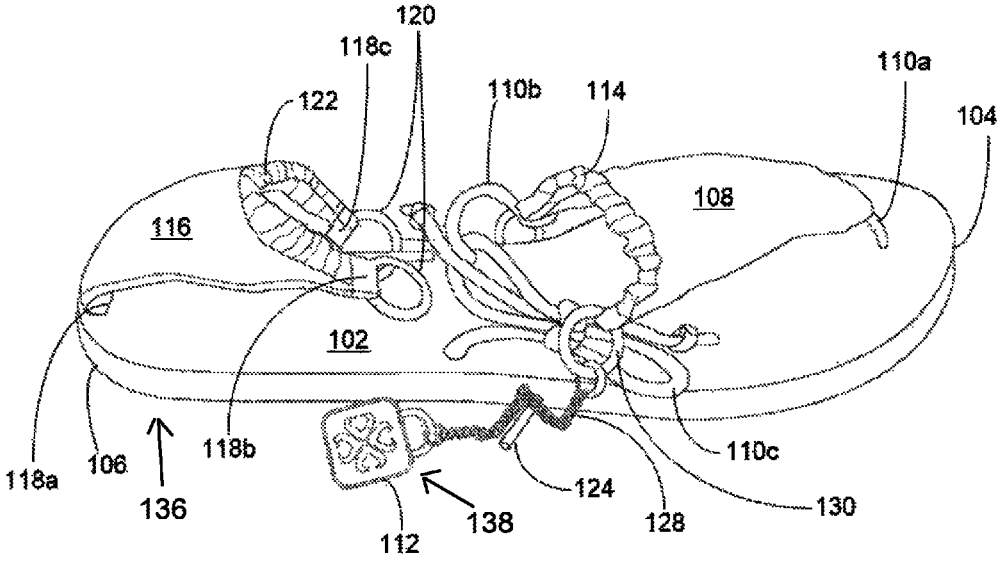
FIG. 3 illustrates a perspective side view of the footwear showing front ornamental members detached from rear fastening members, in accordance with an embodiment of the present invention.
Figure 4:
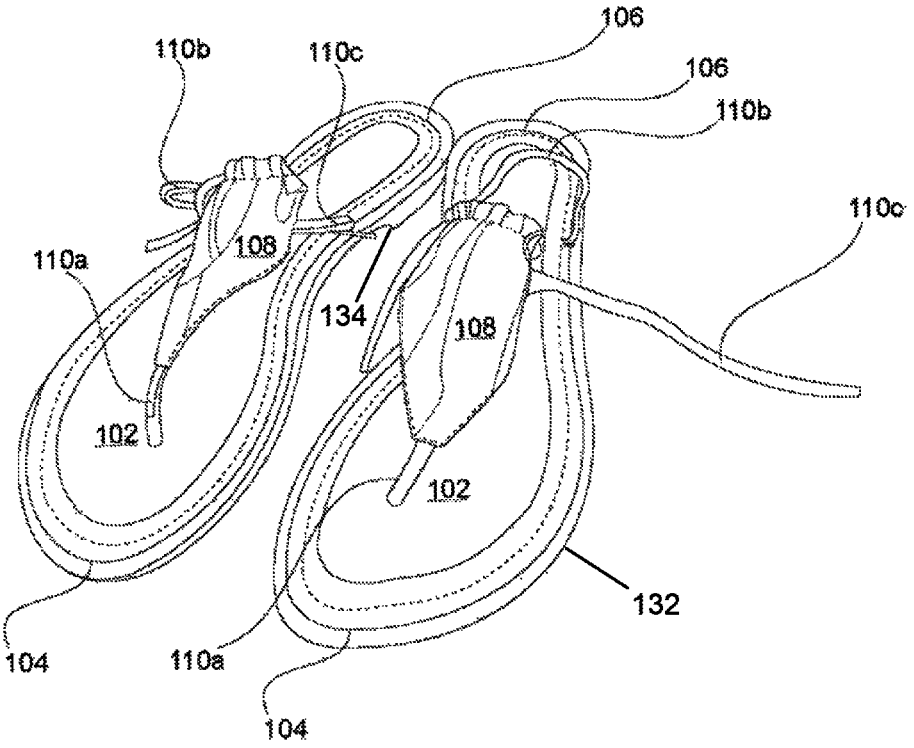
FIG. 4 illustrates a top view of the footwear with swimsuit uppers, showing only a front upper without a rear upper, in accordance with an embodiment of the present invention.

In some embodiments, at least one front ornamental member 112 may attach to the at least one front fastening member 110*a*, 110*b*, 110*c*. The front ornamental member 112 may provide the dual purpose of creating a decorative affect and fastening the front and rear uppers 108, 116 to each other and also to the sole 102 of the footwear 100. The front ornamental member 112 may position anywhere along the length of the front fastening member 110*a*, 110*b*, 110*c*. As shown in FIG. 3, the front ornamental member 112 may include, without limitation, a ring, a charm, an anklet, a necklace, rhinestones, beads, colored stones, diamonds, feathers, crystals, text, and graphics. For example, the at front ornamental member may be a first front ring coupled to the first front corner of the front upper and a second front ring coupled to the second front corner of the front upper. However, the at least one front ornamental member 112 is optional.

In some embodiments, front ornamental member 112 may include a chain 128 and a bar 124. The chain 128 may include, without limitation, a SWAROVSKI® crystal chain, a CHANEL® type leather/metal chain, pure metal chair, art rubber bands, pearls, and many others. The bar 124 may include, without limitation, Rose shape metal, a Citrine, a crystal bar, and many others. Additionally, a charm, a bead, a crystal, and a feather could be attached to either the chain 128 or the bar 124. It is significant to note that the front ornamental portion 112, the chain 128, and the bar 124 are optional.

In one embodiment, the at least one front fastening member 110*a*, 110*b*, 110*c* secures the foot to the sole 102 with the help of the front ornamental member 112. For example, the front ornamental member 112 may have a ring 130 with an attached decorative link. The ring 130 enables the rear upper 116 to fasten thereto, while the decorative link forms a decorative aspect on the footwear 100. In another example of the functionality of the front ornamental member 112, a toggle may attach to the end of the front ornamental member 112 for fastening to the front fastening member 110*a*, 110*b*, 110*c* or the rear upper 116. The toggle may include a bar 124 that passes through a ring 130 and rotates to form a secure connection.

Similarly, the third rear edge of the rear upper 116 may be defined by a rear reinforced edge 122 that helps maintain the rear upper 116 on the heel of the foot. The rear reinforced edge 122 may include an elastic band that encompasses the heel. In some embodiments, the rear upper 116 is defined by at least one rear fastening member 118*a*, 118*b*, 118*c* that joins with the rear sole section 106 and/or the at least one front fastening member 110*a*, 110*b*, 110*c* that extends from the front upper 108.

The at least one rear fastening member 118*a*, 118*b*, 118*c* may include three elongated rear fastening members 118*a*, 118*b*, 118*c* that are arranged at the apexes or first, second and third rear corners of the generally triangular shape on the rear upper 116. The most rearward rear fastening member 118*a* may attach to the most rear area of the rear sole section 106. In this manner, a heel support is formed. The other two rear fastening members 118*b*, 118*c* are more forwardly disposed at the first and second rear corners. These two rear fastening members 118*b*, 118*c* may permanently fasten to the sides of the sole 102, or fasten to the rear upper 116 to wrap around the heel.

Referencing FIG. 2 again, at least one rear ornamental member 120 may attach to the at least one rear fastening member 118*a*, 118*b*, 118*c*. The rear ornamental member 120 may provide the dual purpose of creating a decorative affect and fastening the front and rear uppers 108, 116 to each other and also to the sole 102 of the footwear 100. The rear ornamental member 120 may position anywhere along the length of the rear fastening member 118*a*, 118*b*, 118*c*. For example, the rear ornamental member 120 may be a first rear ring coupled to the first rear corner of the rear upper 116 and a second rear ring coupled to the second rear corner of the rear upper 116.

For example, the rear ornamental member 120 may have a ring 130 with an attached decorative link. In one embodiment, the front fastening member 110*a*, 110*b*, 110*c* ties around the ring 130, while the front ornamental member 112 forms a decorative aspect on the footwear 100. However, in other embodiments, any combination of decorative embellishments may be used. In any case, the front and rear fastening members 110*a*, 110*b*, 110*c*, 118*a*, 118*b*, 118*c* secure the foot to the sole 102 with the help of the front and rear ornamental members 112, 120. It is significant to note that the rear ornamental member 120 is optional.

In another example of the functionality of the rear ornamental member 120 at the first and second rear corners may have connecting members including at least a clip 126 (FIG. 2) may be integrated into the end of the rear ornamental member 120. The clip 126 securely attaches the rear ornamental member 120 to the front fastening member 110*a*, 110*b*, 110*c* or the front ornamental member 112. This forms a secure fastening means to hold down the foot onto the sole 102.

In another example, the connecting members may include a toggle may attach to the end of the rear ornamental member 120 for fastening to a ring 130 attached to the front ornamental member 112. The toggle may include a bar 124 that partially passes through the ring 130 and rotates to form a secure connection thereto. In this manner, the rear upper 116 fastens to the front upper 108 to hold the foot onto the sole 102. While a bar 124 is shown in FIG. 2, the bar 124 may be replaced by various fastening or decorative members, including, without limitation, a ring, a charm, a link, a pearl chain, trinkets, an anklet, a necklace, rhinestones, beads, colored stones, diamonds, feathers, Tiffany® silver, text, and graphics.

Figure 5:
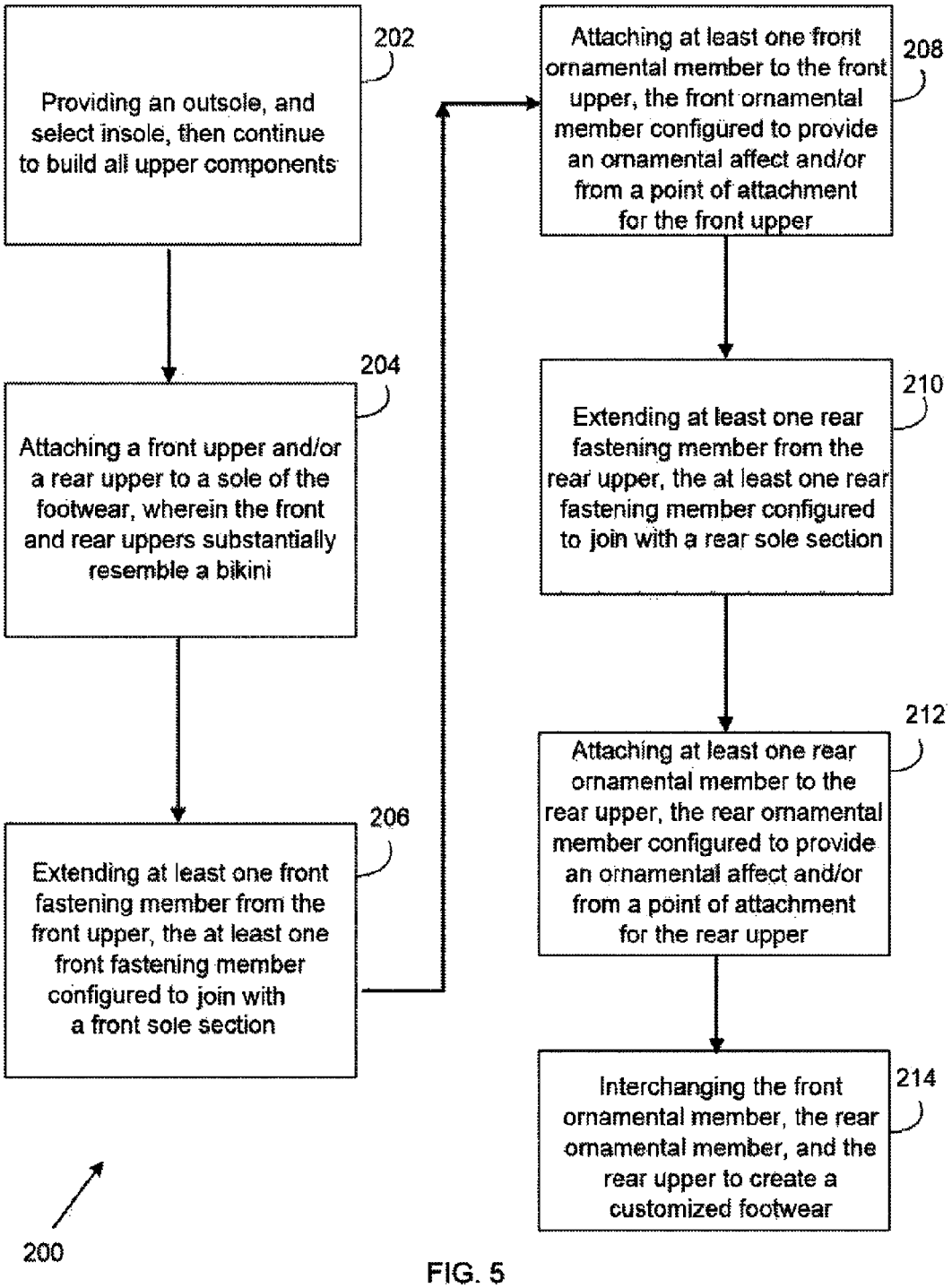
FIG. 5 illustrates a flowchart diagram of an exemplary method for customizing and personalizing footwear with uppers that resemble a bikini and ornamental fasteners, in accordance with an embodiment of the present invention.

FIG. 5 depicts a flowchart diagram of an exemplary method 200 for customizing and personalizing footwear 10 with front and rear uppers 108, 116 that resemble a bikini and also include ornamental fasteners 110*a*, 118*a* and ornamental members 112, 120 to further enhance the decorative appearance and customization of the footwear 100. The method 200 provides an interchangeable and optional rear upper 116 to create a customized personalized bikini-style look to the footwear 100. Front and rear ornamental members 112,120; rear fastening members 118*a*, 118*b*, 118*c*; and front fastening members 110*a*, 110*b*, 110*c* are also joined with the respective upper 108, 116 to create a personalized appearance to the footwear 100.

The method 200 may include an initial Step 202 of providing an outsole, and select insole, then continue to build all upper components. The footwear 100 may include a sole 102 having a front sole section 104, a rear sole section 106, an outsole and an insole. The front sole section 104 may be disposed in the general direction where the toes are placed. The rear sole section 106 may be disposed in the general direction where the heel is placed. The footwear 100 may include, without limitation, sandals, flip flops, tennis shoes, dress shoes, boots, high heels, ballet shoes, penny loafers, and snow shoes.

The method 200 may further comprise a Step 204 of attaching a front upper 108 and/or a rear upper 116 to a sole of the footwear 100, wherein the front and rear uppers 108, 116 substantially resemble a bikini. In some embodiments, the rear upper 116 may be optional. A Step 206 includes extending at least one front fastening member 110*a*, 110*b*, 110*c* from the front upper 108, the at least one front fastening member 110*a*, 110*b*, 110*c* configured to join with a front sole section 104.

In some embodiments, a Step 208 comprises attaching at least one front ornamental member 112 to the front upper 108, the front ornamental member 112 configured to provide an ornamental affect and/or form a point of attachment for the front upper 108. The at least one front fastening member 110*a*, 110*b*, 110*c* secures the foot to the sole 102 with the help of the front ornamental member 112. For example, the front ornamental member 112 may have a ring 130 with an attached decorative link. The ring 130 enables the rear upper 116 to fasten thereto, while the decorative link forms a decorative aspect on the footwear 100.

A Step 210 includes extending at least one rear fastening member 118*a*, 118*b*, 118*c* from the rear upper 116, the at least one rear fastening member 118*a*, 118*b*, 118*c* configured to join with a rear sole section 106. The at least one rear fastening member 118*a*, 118*b*, 118*c* may include three elongated rear fastening members 118*a*, 118*b*, 118*c* that are arranged at the apexes of the generally triangular shape on the rear upper 116. The most rearward rear fastening member 118*a* may attach to the most rear area of the rear sole section 106. In this manner, a heel support is formed.

In some embodiments, a Step 212 may include attaching at least one rear ornamental member 120 to the rear upper 116, the rear ornamental member 120 configured to provide an ornamental affect and/or form a point of attachment for the rear upper 116. The at least one rear ornamental member 120 may attach to the at least one rear fastening member 118*a*, 118*b*, 118*c*. The rear ornamental member 120 may provide the dual purpose of creating a decorative affect and fastening the front and rear uppers 108, 116 to each other and also to the sole 102 of the footwear 100. The rear ornamental member 120 may position anywhere along the length of the rear fastening member 118*a*, 118*b*, 118*c*.

A final Step 214 comprises interchanging the front ornamental member 112, the rear ornamental member 120, and the rear upper 116 to create a customized footwear 100. Each upper 108, 116 is connected to a sole 102 on the footwear 100, and also to each other through various decorative and functional fasteners, including bikini tie strings, toggles, rings, and at least one front fastening member 110*a*, 110*b*, 110*c* and at least one rear fastening member 118*a*, 118*b*,

118*c*. In one embodiment, the rear upper 116 is optional to the footwear 100, so as to provide greater customization and personalization to the footwear 100.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A customizable footwear, comprising:

a sole comprising a front sole section, a rear sole section, an insole and an outsole;

a front upper, wherein the front upper is triangular and comprises a first front edge, a second front edge, a third front edge, a first front corner, a second front corner and a third front corner;

a first front ring coupled to the first front corner of the front upper;

a second front ring coupled to the second front corner of the front upper;

a front fastener coupled to the third front corner of the front upper, the front upper is coupled to the front sole section via the front fastener;

a rear upper, wherein the rear upper is triangular and comprises a first rear edge, a second rear edge, a third rear edge, a first rear corner, a second rear corner and a third rear corner, wherein the third rear corner is directly connected to the rear sole section;

a first rear ring coupled to the first rear corner and the first front ring; and a second rear ring coupled to the second rear corner and the second front ring.

2. The footwear as claimed in claim 1, wherein the footwear is a sandal.

3. The footwear as claimed in claim 1, wherein the third front edge of the front upper is a front reinforced edge.

4. The footwear as claimed in claim 3, wherein the front reinforced edge is an elastic band.

5. The footwear of claim 1, wherein at least one of the first rear edge, the second rear edge, of the third rear edge of the rear upper is a rear reinforced edge.

6. The footwear as claimed in claim 5, wherein the rear reinforced edge is an elastic band.

7. The footwear as claimed in claim 1, further comprising:

a first connecting member comprising a first clip, a first chain and a first bar, wherein the first clip is directly coupled to the first front ring and the first chain, the first bar is directly coupled to the first chain; and a second connecting member comprising a second clip, a second chain and a second bar, wherein the second clip is directly coupled to the second front ring and the second chain, the second bar is directly coupled to the second chain, wherein the front upper is coupled to the rear upper via coupling the first bar to the first rear ring and coupling the second bar to the second rear ring.

8. A method for customizing and personalizing footwear, the method comprising:

providing a sole having a front sole section, a rear sole section, an insole and an outsole;

attaching a front upper, wherein the front upper is triangular and comprises a first front edge, a second front edge, a third front edge, a first front corner, a second front corner and a third front corner;

attaching a first front ring to the first front corner of the front upper;

attaching a second front ring to the second front corner of the front upper;

attaching a front fastener to the third front corner of the front upper and the front sole section;

attaching a rear upper, wherein the rear upper is triangular and comprises a first rear edge, a second rear edge, a third rear edge, a first rear corner, a second rear corner and a third rear corner, and directly connecting the third rear corner to the rear sole section; and attaching a first rear ring to the first rear corner and the first front ring; and attaching a second rear ring to the second rear corner and the second front ring.

* * * * *